US007499657B2

(12) United States Patent
Kim et al.

(10) Patent No.: US 7,499,657 B2
(45) Date of Patent: Mar. 3, 2009

(54) DEVICE AND METHOD FOR MEASURING QUANTITY OF RESIDUAL TONER, IMAGE FORMING APPARATUS HAVING SUCH A DEVICE

(75) Inventors: Young-Min Kim, Suwon-si (KR); Sang-Cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 29 days.

(21) Appl. No.: 11/267,213

(22) Filed: Nov. 7, 2005

(65) Prior Publication Data

US 2006/0098995 A1 May 11, 2006

(30) Foreign Application Priority Data

Nov. 8, 2004 (KR) ..... 10-2004-0090281

(51) Int. Cl.
*G03G 15/08* (2006.01)

(52) U.S. Cl. ..... 399/27

(58) Field of Classification Search ..... 399/27
See application file for complete search history.

(56) References Cited

U.S. PATENT DOCUMENTS 5,459,556 A * 10/1995 Acquaviva et al. ..... 399/58
6,188,863 B1 * 2/2001 Gross et al. ..... 399/316
6,476,837 B2 * 11/2002 Ogata ..... 399/27 X
6,606,462 B2 * 8/2003 Siegel et al. ..... 399/24
2003/0215248 A1 11/2003 Silence et al.
2005/0141905 A1 * 6/2005 Kin et al. ..... 399/27

FOREIGN PATENT DOCUMENTS

JP 09258620 A * 10/1997
JP 2001134062 A * 5/2001
JP 2004-109998 4/2004
KR 100232612 9/1999
KR 1020030014495 2/2003

* cited by examiner

*Primary Examiner*—David M Gray
*Assistant Examiner*—Erika J. Villaluna
(74) *Attorney, Agent, or Firm*—Roylance, Abrams, Berdo & Goodman, LLP

(57) ABSTRACT

An apparatus and method are disclosed for measuring the quantity of residual toner contained in a toner cartridge, and an image forming apparatus having such a device. The inventive device for measuring the quantity of residual toner comprises a controller and a residual toner data memory. The controller selects one of a plurality of preset values for one or more correction coefficients weighted depending on the length of time the toner cartridge has been in printing service, and calculates the quantity of residual toner using the selected value for each correction coefficient and the number of counted dots of a print data. The residual toner memory stores the quantity of residual toner calculated and updated by the controller. According to one exemplary embodiment, the quantity of residual toner can be calculated close to actual value by applying appropriately weighted coefficients.

20 Claims, 5 Drawing Sheets

DEVICE AND METHOD FOR MEASURING QUANTITY OF RESIDUAL TONER, IMAGE FORMING APPARATUS HAVING SUCH A DEVICE

CROSS-REFERENCE TO RELATED APPLICATIONS

This application claims the benefit under 35 U.S.C. § 119(a) of Korean Patent Application No. 2004-90281 filed Nov. 8, 2004 in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a method and apparatus for measuring a quantity of residual toner, wherein the residual toner can be estimated by considering the length of time the associated toner cartridge has been in use. Aspects of the present invention provide a means wherein a user can be informed of the quantity of residual toner.

2. Description of the Related Art

In general, an image forming apparatus, such as a laser printer, comprises a paper-feeding cassette, a toner cartridge containing developer, a print engine for forming and transferring a visible image to a paper fed from the paper-feeding cassette, a fixing unit for fixing the transferred visible image to the paper, and a controller for controlling respective components of the image forming apparatus. The controller also calculates the used or residual toner quantity which is used as developer at the time of printing.

The toner contained in the toner cartridge is developed on a photosensitive medium formed with an electrostatic latent image through a predetermined process, and the toner developed on the photosensitive medium is transferred to a transfer medium by a transfer device. After the toner has been transferred, the photosensitive medium is electrically charged after undergoing a cleaning process, then an electrostatic latent image is formed again on the photosensitive medium, then toner is developed again on the photosensitive medium, and these steps are repeated. The toner transferred to a sheet of paper in this manner is subjected to a fixing process by adequate heat and pressure while being passed through a fixing unit, and one print operation is completed as the paper is discharged.

A conventional method for measuring the quantity of residual toner in such an image forming apparatus is to provide a toner detecting sensor having a light emitting unit and a light receiving unit on a toner cartridge of the print engine. The quantity of toner is detected and, if desired, the user is informed. However, such a method has a problem in that the toner detection sensor and related detection circuit are additional items required, which increases manufacturing costs.

Another conventional method for providing information regarding the quantity of residual toner is to counter the number of pages of papers printed since a new toner cartridge has been changed. This method judges whether toner is exhausted when a quantity of papers exceeding a predetermined number of pages have been printed, and to inform the user that the toner is exhausted. However, such a method calculates the quantity of residual toner on the basis of an average quantity of toner required for printing one page, which is estimated on the basis of about 4% to 5% coverage.

The "4% to 5% coverage" means that the quantity of toner printed on the paper is 4% to 5%, 100% occurring when toner is printed on the entire page. However, since a printed image is generally composed of various patterns—including dot, line, character, text, diagram, picture or the like—the quantity of toner actually used on a given sheet of paper may vary. Therefore, a toner cartridge may not actually be used with as many pages of paper as anticipated.

A recent conventional solution has been to apply a dot counting method to measure the quantity of residual toner. In the dot counting method, each time a page is printed the number of dots per page is counted. When multiple pages are printed, the number of dots per page is counted and accumulated for the totality of pages printed.

The number of printable pages ($P_r$) is calculated by subtracting the number of printed pages per print job ($P_j$) from the quantity of residual toner stored in the residual toner data memory, in other words, the number of residual printable pages ($P_{r-m}$). This calculation e may be expressed by an equation as follows:

$$P_r = P_{r-m} - P_j, \text{ and}$$

$$P_j = Q_j + Q_r \text{ (for each environment).}$$

In the equations above, $Q_j$ is the quantity of consumed toner per job and $Q_r$ is the quantity of consumed toner per reference page, in which the latter is set on the basis of 5% coverage for A4 size page.

Since the quantity of consumed toner per job ($Q_j$) indicates the quantity of transferred toner ($Q_t$) plus the quantity of produced waste toner ($Q_w$), the number of printable pages may be expressed as follows:

$$P_r = P_{r-m} - \{(Q_t + Q_w)/Q_r\}.$$

The quantity of transferred toner ($Q_t$) is calculated by adding the values obtained by multiplying the number of dots per each page ($N_{dot}$), the quantity of transferred toner per dot ($q_{dot}$) and a weighting factor (solid/text/gray), and is expressed as follows:

$$Q_t = \Sigma(x \cdot N_{dot} \cdot q_{dot}).$$

In the equation above, x is a weighting factor that changes depending on various image information of a print data, such as dot, line, character, text, diagram, picture, or the like.

As can be seen from the equations above, the quantity of residual toner, that is the number of residual printable pages ($P_r$), can be calculated only when the quantity of toner per dot ($q_{dot}$) consumed is calculated. Thus, the quantity of residual toner can be calculated only when the quantity of transferred toner ($Q_t$) and the quantity of waste toner ($Q_w$) have been calculated.

However, the conventional method for measuring quantity of residual toner is calculated by using calculated values rather than by accurately measuring the quantity of transferred and waste toner. Accordingly, as the quantity of toner used or the length of time that the toner is used increases, an offset is created that represents deviation from the actual value of residual toner. In general, once a toner cartridge is installed for printing, toner stress, deterioration and wear of components occur as time goes by. Toner stress increases as time goes by so that the toner can no longer sufficiently exhibit the performance originally possessed by fresh toner. This results in poor image quality. Furthermore, since image developing efficiency and electrified characteristic (Q/M) of the toner are also changed, the quantity of produced waste toner is also changed. Moreover, the performance of essential components such as an image developing roller and feeding roller of the toner cartridge, a photosensitive medium, and a charging roller, also deteriorate, thereby worsening the above-mentioned problems. In addition, because various toner parameters depend on density of print data or printing environment, an offset deviation from actual value occurs.

Due to the problems identified above, there will be an error between the measured value and actual value as to the quantity of residual toner. If the error is large, a user cannot be informed of the correct time for changing the toner cartridge because the information related to the quantity of residual toner, life span of one or more components, quantity of waste toner, or the like, is incorrect. Ultimately, image quality cannot be maintained.

SUMMARY OF THE INVENTION

Accordingly, aspects of the present invention are made to solve the above-mentioned problems. An object of an exemplary embodiment of the present invention is to provide a method and apparatus for measuring the quantity of residual toner that can calculate the quantity of residual toner contained in a toner cartridge in a manner that is close to the actual value by representing various correction coefficients obtained by considering various parameters at the time of printing.

In order to achieve the above-mentioned object, according to an aspect of the present invention, there is provided an apparatus for measuring the quantity of residual toner received in a toner cartridge. The apparatus comprises a controller for selecting one among multiple preset values for each correction coefficient. The value is weighted depending on the length of time the toner cartridge has been used in printing service. The quantity of residual toner is then calculated using the selected values for multiple correction coefficients and the counted number of dots of a print data. The apparatus further comprises a residual toner data memory, wherein the quantity of residual toner calculated by the controller is updated and stored in the residual toner data memory.

It is preferable that the multiple values of correction coefficients include multiple values for a transferred toner quantity correction coefficient ($k_1$) and multiple values for a waste toner quantity correction coefficient ($k_2$), each of which are weighted depending on the length of time the toner cartridge has been in printing service.

It is also preferable that the multiple values for the correction coefficients further include multiple values for a paper-feeding mode correction coefficient ($k_3$), which are applied differently depending on whether single-sided or double-sided printing is performed.

The controller may comprise a coefficient memory for storing multiple preset values for the correction coefficients, a counter unit for counting the number of dots and number of pages for print data, and an operation unit for selecting one value for each correction coefficient among the multiple values stored in the coefficient memory. The operation unit calculates the quantity of residual toner using selected values for the correction coefficients and the number of dots of print data counted by the counter unit. It also updates and stores the calculated quantity of residual toner in the data memory.

The coefficient memory may further store multiple values for a resolution coefficient ($k_4$), which is changed depending on resolution of the print data. The operation unit selects one value among the multiple values for the resolution coefficient to calculate the quantity of residual toner additionally using the selected value for the resolution correction coefficient.

In addition, the coefficient memory may further store multiple values for a density correction coefficient ($k_5$), which changes depending on the density of print data. The operation unit selects one among multiple values of the density correction coefficient to calculate the quantity of residual toner and then uses the selected value for the density correction coefficient.

In addition, the coefficient memory may further store multiple values for a toner saving mode correction coefficient ($k_6$), which changes depending on toner saving mode. The operation unit selects one among multiple values for the toner saving mode correction coefficient to calculate the quantity of residual toner and then uses the selected value for the toner saving mode correction coefficient.

Furthermore, the coefficient memory may store multiple values for an environmental correction coefficient (e), which changes depending on the environmental condition preset according to at least one of temperature and humidity. The operation unit selects one of the multiple values for the environmental correction coefficient depending on at least one of temperature and humidity to calculate the quantity of residual toner and then uses the selected environmental correction coefficient.

In one exemplary embodiment, the residual toner data memory is mounted on a side of the toner cartridge.

Meanwhile, the inventive device for measuring the quantity of residual toner preferably comprises a display unit for externally displaying the quantity of residual toner calculated by the controller.

According to another aspect of the present invention, there is provided an image forming apparatus comprising a toner cartridge for containing toner, a residual toner data memory for storing data information related to intrinsic information of the toner cartridge and data information related to the quantity of residual toner, the residual toner dater memory being mounted on a side of the toner cartridge. The image forming apparatus further comprises a controller for calculating the quantity of residual toner using plural preset values for a transferred toner quantity correction coefficient ($k_1$), a waste toner quantity correction coefficient ($k_2$), and a paper-feeding mod coefficient, each of which is changed depending on the length of time the toner cartridge has served on printing, and the counted number of dots of a print data, wherein the controller update and store the calculated quantity of residual toner in the residual toner data memory. The image forming apparatus further comprises a display unit for externally displaying the quantity of residual toner calculated by the controller.

It is preferable that the controller calculates the quantity of residual toner additionally using one or more values each selected among multiple values preset for a resolution coefficient ($k_4$) that changes depending on the resolution of print data, a density correction coefficient ($k_5$) that changes depending on the density of a print data, a toner saving mode correction coefficient ($k_6$) that changes depending on toner saving mode, and an environmental correction coefficient (e) that changes depending on environmental condition preset according to at least one of temperature and humidity.

In addition, it is preferable that the inventive image forming apparatus further comprises a manipulation panel for allowing a user to input information so that the controller can select one value for each of the multiple correction coefficients that change depending on a particular condition.

In order to achieve the above-mentioned object, there is also provided a method of measuring the quantity of residual toner comprising steps of counting the number of dots of print data, selecting one value for each of multiple preset correction coefficients, each coefficient being weighted depending on the length of time a toner cartridge has served on printing, calculating the quantity of residual toner using the selected values for the correction coefficients and the counted number of dots, and storing the calculated quantity of residual.

The step of selecting one value for each correction coefficient may comprise steps of selecting one of plural values for a transferred toner quantity correction coefficient ($k_1$), selecting one of plural values for a waste toner quantity correction coefficient ($k_2$), and selecting one of plural values for a paper-feeding mode correction coefficient ($k_3$), which is applied differently depending on whether single-side mode or double-side printing modes are performed.

In addition, the step of selecting one value for each correction coefficient may further comprise the step of selecting one of multiple values for a resolution correction coefficient ($k_4$) that changes depending on the preset resolution of the print data.

In addition, the step of selecting one value for each correction coefficient may further comprise the step of selecting one of multiple values for a density correction coefficient ($k_5$) that changes depending on the preset density of the print data.

Furthermore, the step of selecting one value for each correction coefficient may further comprise the step of selecting one of multiple values of a saving mode correction coefficient ($k_6$) that changes depending on preset toner saving mode.

Moreover, the step of selecting one value for each correction coefficient further comprises the step of selecting one of multiple values of an environmental correction coefficient (e) that changes depending on at least one of temperature and humidity.

It is preferable that the inventive method for measuring the quantity of residual toner further comprises the step of externally displaying the calculated quantity of residual toner.

BRIEF DESCRIPTION OF THE DRAWINGS

The above aspects and features of the present invention will be more apparent by describing certain embodiments of the present invention with reference to the accompanying drawings, in which.

Throughout the drawings, like reference numerals should be understood to refer to like elements, features, and structures.

DETAILED DESCRIPTION OF EXEMPLARY EMBODIMENTS

Exemplary embodiments of the present invention will now be described in greater detail with reference to the accompanying drawings. The matters exemplified in this description are provided to assist in a comprehensive understanding of various embodiments of the present invention disclosed with reference to the accompanying figures. Accordingly, those of ordinary skill in the art will recognize that various changes and modifications of the exemplary embodiments described herein can be made without departing from the scope and spirit of the claimed invention. Descriptions of well-known functions and constructions are omitted for clarity and conciseness.

Figure 1:
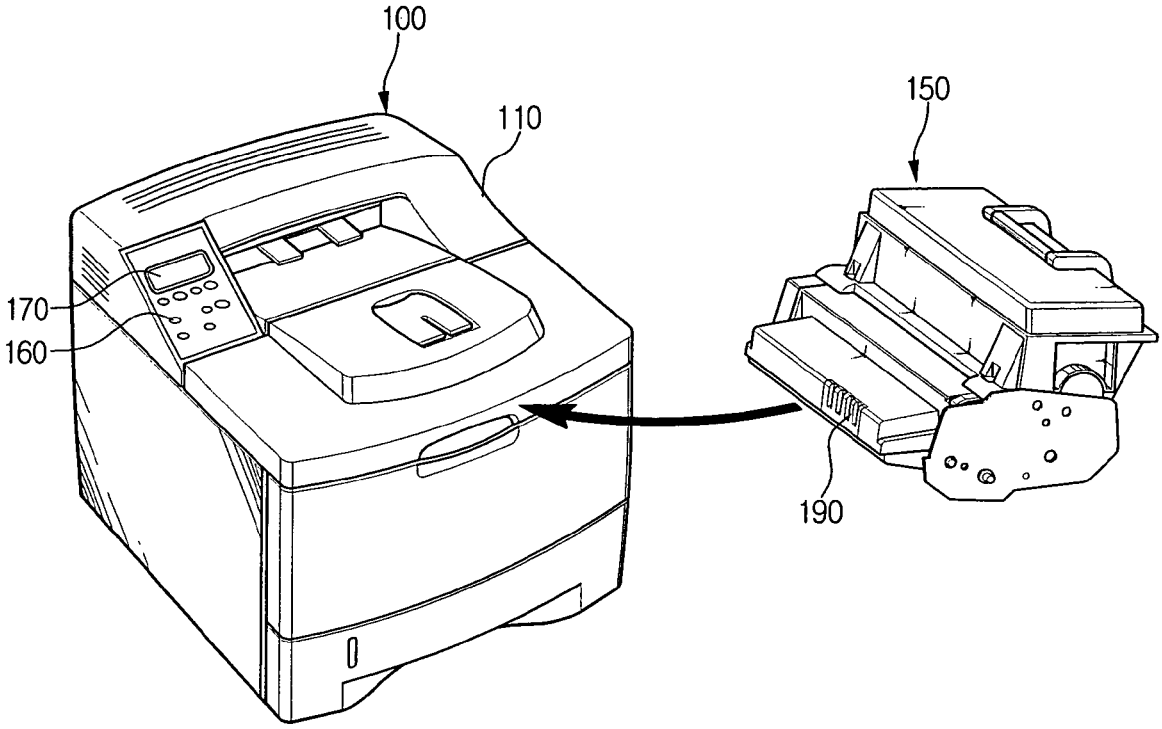
FIG. 1 illustrates a schematic perspective view of an image forming apparatus in accordance with an exemplary embodiment of the present invention.
Figure 2:
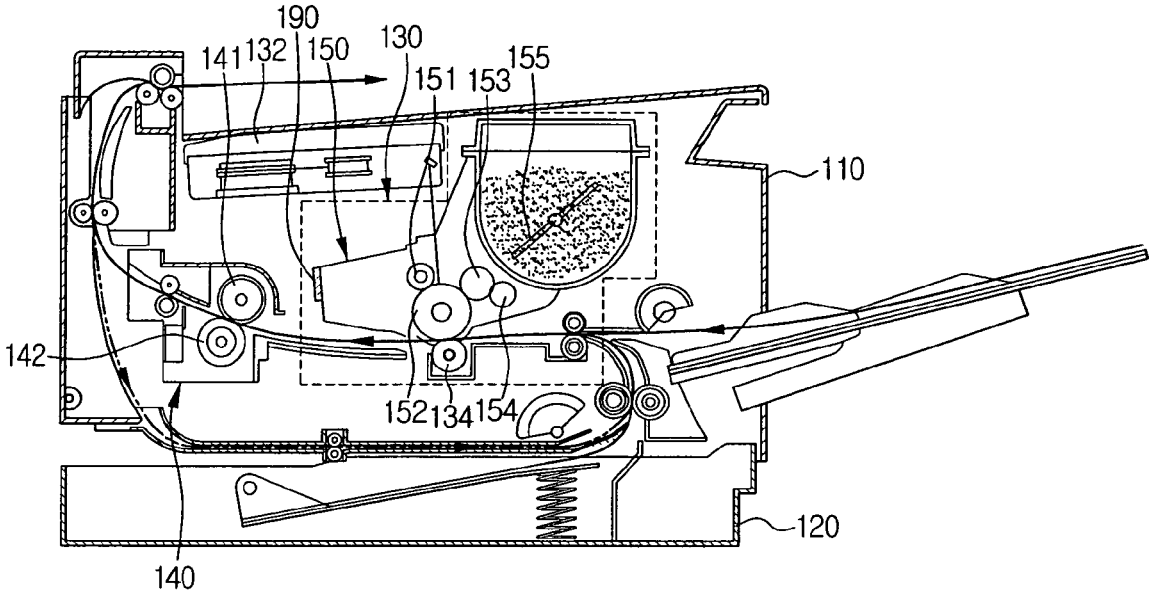
FIG. 2 illustrates a lateral cross-sectional view of the image forming apparatus in a state in which the toner cartridge is mounted in the image forming apparatus in accordance with an exemplary embodiment of the present invention.
Figure 3:
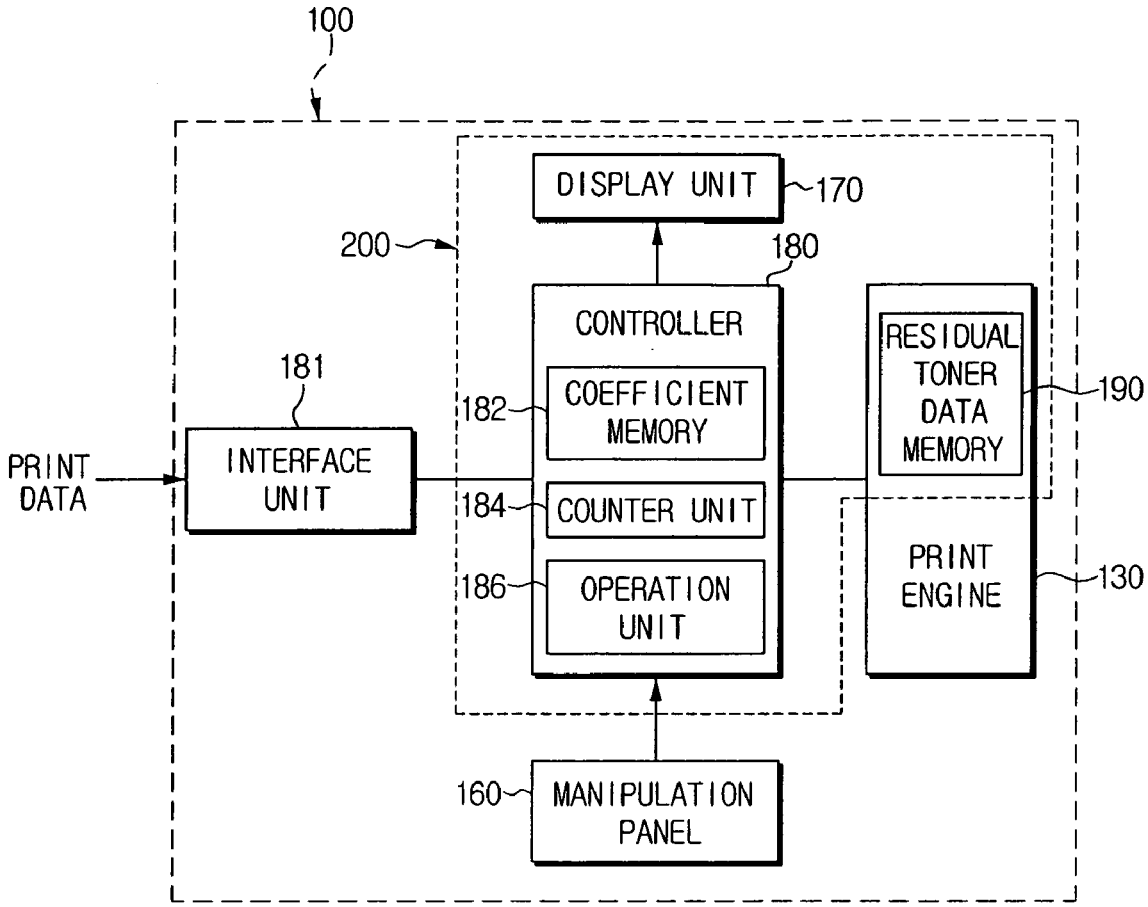
FIG. 3 shows a block diagram illustrating a diagrammatic configuration of the mage forming apparatus in accordance with an exemplary embodiment of the present invention.

Referring to FIGS. 1 through 3, an image forming apparatus 100 according to an exemplary embodiment of the present invention includes a body 110, a paper feeding cassette 120 for feeding a paper as a print medium, a print engine 130 for forming a visible image with developer and transferring the visible image to the paper fed from the paper feeding cassette 120, a fixing unit 140 for fixing the transferred visible image on the paper, a manipulation panel 160, and a device 200 for measuring the quantity of residual toner.

The print engine 130 includes a photosensitive medium 152 with a surface being electrically charged to a predetermined level of voltage by a charging roller 151 so that an electrostatic latent image is formed on the surface, a laser scanning unit 132 for scanning laser beam to the electrically charged photosensitive medium 152, a developing unit for feeding developer to the photosensitive medium 152, and a transfer roller 134 in contact with the photosensitive medium 152 to transfer the visible image formed on the photosensitive medium 152. In general, the photosensitive medium 152 and developing unit are consumable products and typically manufactured as a set (hereinafter referred to as toner cartridge 150) and is capable of being replaced when the set has served its time. Toner cartridge 150 contains developer, such as toner, within its interior and includes a developing roller 153 for feeding toner to the photosensitive medium 152, a developing roller 154, a toner layer restraint member (not shown) for maintaining the toner to a predetermined thickness while in contact with the developing roller 153, and a stirrer 155 for stirring the toner contained within the toner cartridge 150.

The fixing unit 140 includes a heating roller 141 and a pressing roller 142 for applying heat and pressure to paper with a transferred image, thereby fixing the transferred image to the paper.

The manipulation panel 160 is mounted on the front surface of body 110 of the image forming apparatus to input a user's command or selection.

The device 200 for measuring the quantity of residual toner includes a display unit 170, a residual toner data memory 190, and a controller 180.

The display unit 170 is installed adjacent to the manipulation panel 160 and can display the quantity of residual toner calculated by the controller 180.

The residual toner data memory 190 is stored with the quantity of residual toner, in other words, the number of printable pages (Pr) calculated by the controller 180 after a print operation has been executed. The residual toner data memory 190 can be implemented by a writable/erasable non-volatile memory. According to an exemplary embodiment of the present invention, it is preferable to install the residual toner data memory 190 on a side of the toner cartridge as shown in FIG. 1 so as to save manufacturing costs. The residual toner data memory 190 is also stored with inherent information, history of use, etc., of the toner cartridge 150. However, the present invention is not limited to this embodiment, and the residual toner data memory 190 may be installed, for example, within the body 110 of the image forming apparatus. In that event, inherent information, history of use, etc., of toner cartridge 150 are not stored in the residual toner data memory 190.

The controller 180 internally processes print data transmitted through an interface unit 181 from an external computer (not shown) and controls respective components of the image forming apparatus, including the print engine 130, to perform printing.

The controller 180 reads the existing residual toner quantity data stored in the residual toner data memory 190 at the time of a printing operation, computes the consumption quantity of toner and the quantity of waste toner to calculate the number of printed pages per job ($P_j$) while a printing operation is being performed, and calculates the quantity of residual toner, in other words, the number of printable pages ($P_r$) on the basis of the number of printed pages per job. The number of printable pages ($P_r$) is calculated by subtracting the number of printed pages per job ($P_j$) used in the present printing operation from the quantity of residual toner, in other words, the number of residual printable pages ($P_{r-m}$) stored in the residual toner data memory at the time of the printing operation. This may be expressed by following equation:

$$P_r=P_{r-m}-P_j \tag{1}$$

where $P_r$ is the number of printable pages, $P_{r-m}$ is the number of residual printable pages, and $P_j$ is the number of printed pages per job, and the number of printable pages ($P_r$) equals to $Q_j/Q_r$. $Q_j$ is the quantity of consumed toner per job and $Q_r$ is the quantity of consumed toner per reference page for each environment. The quantity of consumed toner per reference page ($Q_r$) is determined on the basis of 5% coverage for an A4 size sheet.

Because the quantity of consumed toner per job ($Q_j$) is the quantity of transferred toner ($Q_t$) plus the quantity of produced waste toner ($Q_w$) (for each environment), the number of printable pages ($P_r$) may be expressed by following equation:

$$P_r=P_{r-m}-P_j=P_{r-m}-(Q_j/Q_r)=P_{r-m}-\{(Q_t+Q_w)/Q_r\} \tag{2}$$

where $Q_j$ is the consumed toner per job, $Q_r$ is the quantity of consumed toner per reference page, $Q_t$ is the quantity of transferred toner, and $Q_w$ is the quantity of waste toner produced.

Because the quantity of transferred toner ($Q_t$) is calculated by summing the values obtained by the product of the number of dots per page ($N_{dot}$), a correction coefficient for each mode (k), and a weighting factor (Solid/Text/Gray). The transferred toner ($Q_t$) may be expressed by following equation:

$$Q_t=\Sigma(x\cdot k\cdot e_1\cdot N_{dot}\cdot q_{dot}) \tag{3}$$

where k ($k_1$, $k_2$, . . . , k) is a correction coefficient for each mode and is employed to correctly calculate the quantity of toner actually used by applying a weighting value depending on how long a toner cartridge 150 has been in printing service, and has different values according to various conditions. The value "e" is a correction coefficient for each environment, which is employed to calculate the quantity of transferred toner actually produced by applying a weighting value depending on the environment. The value "x" is a weighting factor that is variable depending on various information of print data, such as dot, line, character, text, diagram, image, etc. The value $q_{dot}$ is the quantity of transferred toner per dot.

The quantity of produced waste toner ($Q_w$) is the product of correction coefficients ($k_2$, $k_3$), which are employed to correctly calculate the quantity of waste toner actually produced by applying a weighting value that depends on how long a toner cartridge 150 has been in printing service, an environmental correction coefficient ($e_2$), the length of time for rotating a photosensitive medium ($t_r$), and the BG quantity per unit time ($Q'_{BG}$). The quantity of produced waste toner ($Q_w$) may be expressed by following equation:

$$Q_w=k\cdot e_2\cdot t_r\cdot Q'_{BG} \tag{4}$$

where $Q'_{BG}$ is the sum of the extent of a paper section and the extent of a non-paper section. The paper section is calculated in consideration of the length of time for feeding a paper to the photosensitive medium, and the non-paper section is calculated in consideration of the length of time for driving a motor for the photosensitive medium when the quantity of produced waste toner is calculated.

As indicated in equations (1) to (4) for calculating the quantity of toner consumed at the time of a printing operation, that is, the number of printed page per job, the quantity of transferred toner, and the quantity of produced waste toner are varied depending on an individual condition at the time of printing and the quantity of toner used at the time of printing to meet such a condition.

The controller 180 applies various correction coefficients so as to accurately calculate the quantity of toner used in printing and comprises a counter unit 184, an operation unit 186, and a coefficient memory 182 for storing the various correction coefficients.

The counter unit 184 calculates the number of dots and the number of pages for transmitted print data.

The operation unit 186 reads the existing residual toner quantity data stored in the residual toner data memory 190, selects one value for each correction coefficient that meets with the printing condition from plural correction coefficients k stored in the coefficient memory 182, and calculates the quantity of residual toner using the number of dots ($N_{dot}$) of print data counted by the counter unit 184 and selected values. In addition, the operation unit 186 updates and stores the calculated quantity of residual toner in the residual toner quantity memory 190 after the printing operation has been completed.

The coefficient memory 182 is stored with a plurality of values for a correction coefficient related to the preset quantity of consumed toner, which is weighted depending on how much toner has been used, that is, how long a toner cartridge has been in printing service. The coefficient memory 182 is also stored with correction coefficients each having a plurality of values that change depending on various surrounding environments and modes, beyond the toner consumption quantity coefficients. The correction coefficients (k, e) are calculated by optimum values obtained through repeated tests for measuring the quantity of practically consumed toner when images are printed under various conditions while varying the length of time a cartridge has served on printing.

The correction coefficients (k, e) for each mode are classified into correction coefficients related to the extent of use (life span) of a toner cartridge ($k_1$ and $k_2$), a correction coefficient related to a paper-feeding mode ($k_3$), a correction coefficient related to resolution ($k_4$), a correction coefficient related to output concentration ($k_5$), a correction coefficient related to a toner saving mode ($k_6$), a correction coefficient related to strengthening of image quality ($k_7$), and a correction coefficient (e) related to a surrounding environmental condition.

The correction coefficient ($k_1$) indicates the change in quantity of consumed toner depending on how long a toner cartridge has been in printing service, and the correction coefficient ($k_2$) indicates the change in quantity of waste toner. As described above, the quantity of consumed toner usually changes as time goes by, due to toner stress, deterioration and wear of components, etc. Toner stress increases as time goes by so that the toner cannot sufficiently exert the performance possessed by original fresh toner. This results in poor image quality. Furthermore, because the developing efficiency and electrification characteristic (Q/M) of the toner also change, the quantity of consumed toner will also vary as time goes by. In particular, since the transfer efficiency most greatly affecting the toner consumption quantity during the developing process changes, the quantity of produced waste toner also varies.

It will now be described how to apply coefficients $k_1$ and $k_2$ as the transfer efficiency is changes in connection with the life span of a cartridge in more detail using various values obtained through a test.

In this test, the velocity of a processor is 120 mm/sec, the life span of a developing unit is 15,000 pages, and the printing mode is one-sided printing mode. The specification of respective components of the image forming apparatus used in this test was as follows.

The toner contained in toner cartridge 150 is a synthetic black toner consisting of a polyester based resin mixed with silica of about 2% and carbon black of about 4%. The mean grain size of the toner is about 8.0 μm, in which the content of fine powders (grain size is not more than 5 μm) is about 20% and the content of coarse powders (grain size is not less than 15 μm) is about 0.8%, and the toner has a glass transition temperature ($T_g$) of about 65° C. and a specific gravity of about 0.4 g/cm$^2$.

The developing roller 153 is formed of a nitrile-butadiene rubber (NBR) material having an outer diameter in the range of 14.0 to 14.10 mm surrounding an axle having an outer diameter of 6 mm, wherein the developing roller has an the environmental resistance of 0.5 to 1 MΩ (measured while applying 500V-DC) at the normal temperature and humidity (23° C., 55%), a surface roughness (Ra) of about 2.0 μm (measured using Mahr equipment), a frictional coefficient of about 0.3, and a surface hardness of about 49 degrees (Asker-A measurement).

The feeding roller 154 is formed of a conductive silicon foam material having an outer diameter of about 11.5 mm and has an environmental resistance of about 0.1 MΩ, a hardness of about 30 degrees (Asker-C measurement). The feeding roller 154 is electrically charged by friction while being reverse-rotated in relation to the developing roller 153.

The developer layer restraint element (Doctor Blade) not shown in the drawings is formed from stainless steel of a thickness of 0.08 mm to be elastically in contact with the developing roller 153, and comprises a metallic bracket for supporting the stainless steel.

The stirrer 155 has screw-shaped augers (not shown) attached on either sides of the stirrer 155 by a predetermined distance, and a FET-film attached over the entirety of the stirrer for the purpose of feeding toner to a supporting axis.

The charging roller 151 is formed of an NBR having an outer diameter of 12 mm surrounding an axle having an outer diameter of 6 mm, and has an environmental resistance of 1 MΩ at normal temperature, a surface roughness Ra of 2.0 μm, a frictional coefficient of 0.3, and a surface hardness of 50 degrees (Asker-A measurement).

Figure 4:
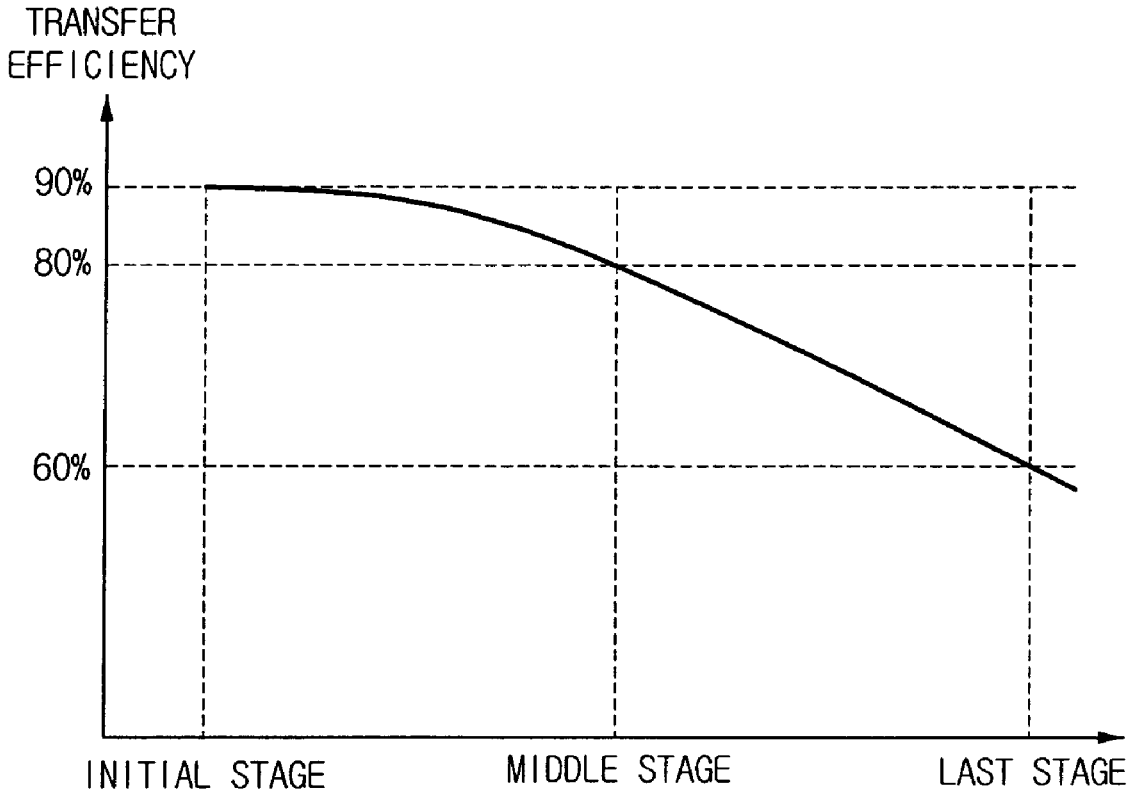
FIG. 4 depicts a graph of transfer efficiency with respect to the life span of toner cartridge.
Figure 5:
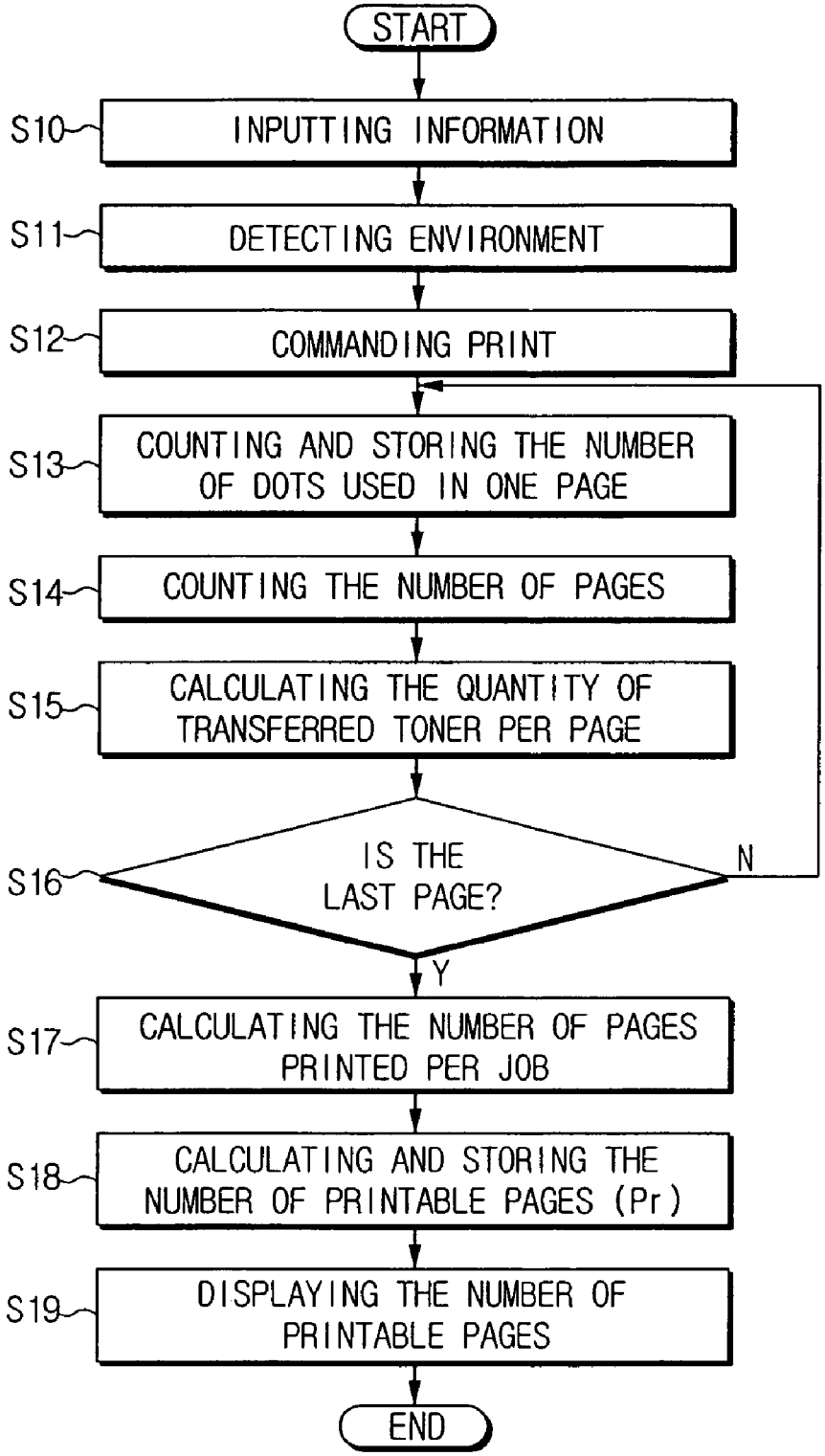
FIG. 5 shows a flowchart illustrating a method of measuring the quantity of residual toner in accordance with to an exemplary embodiment of the present invention.

FIG. 4 shows transfer efficiency in relation to the life span of an ordinary toner cartridge 150. The transfer efficiency is reduced as the toner cartridge is in the initial stage, middle stage and the last stage of its life span. Here, the initial stage of the life span indicates a time interval during which about 2,500 pages of paper are printed, the middle stage indicates a time interval during which 7,500 pages of paper are printed following the initial stage, and the last stage indicates a time interval during which about 14,000 pages of paper are printed following the middle stage. If the transfer efficiency is reduced, the quantity of waste toner will be increased. In addition, since the amount of developed toner per unit area for a paper is increased as the life span of the cartridge increases, the quantity of consumed toner will also increased.

In view of these points, the quantity of consumed toner and the quantity of waste toner at the time of printing are distinctly preset and weighted depending on how long a toner cartridge has been in printing service.

Tables 1 to 3 show data obtained through tests performed in connection with the quantity of transferred toner and the quantity of waste toner to show the differences in connection with the quantity of consumed toner and the quantity of waste toner. These values vary depending on how long a toner cartridge has been in printing service. In particular, there are shown the quantity of transferred toner per page and the quantity of waste toner per page measured when the toner cartridge prints the 1,000$^{th}$ page, the 5,000$^{th}$ page, and the 10,000$^{th}$ page, respectively.

TABLE 1

| At the time of printing 1,000$^{th}$ page | Quantity of transferred toner per page 0.021497 | Quantity of waste toner per page 0.002482 |
|---|---|---|
| $k_1$, $k_2$ | 1.0 | 1.0 |

TABLE 2

| At the time printing 5,000$^{th}$ page | Quantity of transferred toner per page 0.028421 | Quantity of waste toner per page 0.002647 |
|---|---|---|
| $k_{1a}$, $k_{2a}$ | 1.322091 | 1.066479 |

TABLE 3

| At the time printing 10,000$^{th}$ page | Quantity of transferred toner per page 0.030211 | Quantity of waste toner per page 0.002857 |
|---|---|---|
| $k_{1b}$, $k_{2b}$ | 1.405359 | 1.151088 |

Referring to Tale 1, at the time of printing the 1,000$^{th}$ page, the quantity of transferred toner per page is 0.021497 g and the quantity of waste toner per page is 0.002482 g. Since intrinsic characteristics of the toner contained in a toner cartridge and various components of the toner cartridge at the time of printing the 1,000$^{th}$ page are not substantially different from those of a new cartridge, the values of $k_1$ and $k_2$ are calculated on the basis of those of a new toner cartridge.

Referring to Table 2, at the time of printing the 5,000$^{th}$ page, the quantity of transferred toner per page is 0.028421 g and the quantity of waste toner per page is 0.002647 g. Therefore, in reference to the length of time the toner cartridge has been in printing service, the weighting correction coefficient for the quantity of transferred toner ($k_{1a}$=the quantity of transferred toner per page at the time of printing the 5,000$^{th}$ page/the quantity of transferred toner per page at the time of printing the 1,000$^{th}$ page) is 1.32 (rounded off to two decimal places) and the weighting correction coefficient for the quantity of waste toner ($k_{2a}$=the quantity of waste toner per page at the time of printing 5,000$^{th}$ page/the quantity of waste toner per page at the time of printing 1,000$^{th}$ page) is 1.07 (rounded off to two decimal places).

Referring to Table 3, at the time of printing the 10,000$^{th}$ page, the quantity of transferred toner per page is 0.030211 g and the quantity of waste toner per page is 0.002857 g. Therefore, in reference to the length of time the toner cartridge has been in printing service, the weighting correction coefficient for the quantity of transferred toner ($k_{1a}$=the quantity of transferred toner per page at the time of printing the 10,000$^{th}$ page/the quantity of transferred toner per page at the time of printing the 1,000$^{th}$ page) is 1.41 (rounded off to two decimal places) and the weighting correction coefficient for the quantity of waste toner ($k_{2a}$=the quantity of waste toner per page at the time of printing 10,000$^{th}$ page/the quantity of waste toner per page at the time of printing the 1,000$^{th}$ page) is 1.15 (rounded off to two decimal places).

The quantity of transferred toner and the quantity of waste toner are weighted with a relative ratio depending on how long the toner cartridge has been in printing service. Accordingly, in equation (3) for calculating the quantity of transferred toner on the basis of information stored in the residual toner data memory 190, predetermined values $k_1$=1 and $k_2$=1 are applied until the toner cartridge has printed up to 2,500 pages, $k_{1a}$=1.32 and $k_{2a}$=1.07 are applied when the toner cartridge prints from 2,500 to 7,500 pages, and $k_{1b}$=1.41 and $k_{2b}$=1.15 are applied when the toner cartridge prints between 7.500 to 15,000 pages of paper. These values help to calculate the quantity of consumed toner and thereby ensure accuracy in estimating the quantity of residual toner.

Although this exemplary embodiment classifies the life span of a cartridge into three stages, it is possible to classify the life span into more stages depending on a manner and characteristic of embodying the present invention, and thereby obtain more detail. Using more parameters will make it possible to accurately increase the estimate of the quantity of residual toner.

According to an aspect of the present invention, the number of printable pages of paper, which corresponds to a residual toner quantity, can be estimated close to an actual value by applying correction coefficients $k_1$ and $k_2$ obtained by considering a transfer efficiency depending on the length of time the toner cartridge has been in printing service.

When an image forming apparatus performs double-sided printing, the quantity of transferred toner and the quantity of waste toner will also vary depending on how long a toner cartridge has been in printing service.

Tables 4 to 6 show data obtained through tests performed in connection with the quantity of transferred toner and the quantity of waste toner depending on how long a toner cartridge has been printing in double-sided printing mode, where the image forming apparatus employed in double-sided printing mode was same as that employed in the single-sided printing mode example.

TABLE 4

| At the time of the 1,000$^{th}$ page | Quantity of transferred toner per page | Quantity of waste toner per page |
|---|---|---|
| Double-side printing | 0.024471 | 0.002757 |
| Single-side printing | 0.021497 | 0.002482 |
| $k_{3a}$ | 1.138361 | 1.111069 |

TABLE 5

| At the time of the 5,000$^{th}$ page | Quantity of transferred toner per page | Quantity of waste toner per page |
|---|---|---|
| Double-side printing | 0.034156 | 0.003156 |
| Single-side printing | 0.028421 | 0.002647 |
| $k_{3b}$ | 1.201801 | 1.19241 |

TABLE 6

| At the time of the 1,000$^{th}$ page | Quantity of transferred toner per page | Quantity of waste toner per page |
|---|---|---|
| Double-side printing | 0.038459 | 0.003912 |
| Single-side printing | 0.030211 | 0.002857 |
| $k_{3c}$ | 1.273041 | 1.369241 |

Referring to Table 4, at the time of printing the 1,000$^{th}$ page in double-sided printing, the quantity of transferred toner per page is 0.024471 g and the quantity of waste toner per page is 0.002757 g. Therefore, in relation to the length of time the toner cartridge has been in printing service in double-sided printing mode, it can be appreciated that the weighting correction coefficient for the quantity of transferred toner ($k_{3a}$=the quantity of transferred toner per page at the time of double-sided printing/the quantity of transferred toner per page at the time of single-sided printing) is 1.14 (rounded off to two decimal places) and the weighting correction coefficient for the quantity of waste toner is 1.11 (rounded off to two decimal places).

Referring to Table 5, at the time of printing the 5,000$^{th}$ page in double-sided printing, the quantity of transferred toner per page is 0.034156 g and the quantity of waste toner per page is 0.003156 g. Therefore, in relation to the length of time the toner cartridge has been in printing service in double-sided printing mode, it can be appreciated that the weighting correction coefficient for the quantity of transferred toner ($k_{3b}$=the quantity of transferred toner per page at the time of double-sided printing/the quantity of transferred toner per page at the time of single-sided printing) is 1.20 (rounded off to two decimal places) and the weighting correction coefficient for the quantity of waste toner is 1.19 (rounded off to two decimal places).

Referring to Table 6, at the time of printing the 10,000$^{th}$ page in double-sided printing, the quantity of transferred toner per page is 0.038459 g and the quantity of waste toner per page is 0.003912 g. Therefore, in relation to the length of time the toner cartridge has been in printing service in double-sided printing mode, it can be appreciated that the weighting correction coefficient for the quantity of transferred toner ($k_{3c}$=the quantity of transferred toner per page at the time of double-sided printing/the quantity of transferred toner per page at the time of single-sided printing) is 1.27 (rounded off to two decimal places) and the weighting correction coefficient for the quantity of waste toner is 1.37 (rounded off to two decimal places).

In double-sided printing mode, the weighting correction coefficient depending on the length of time a cartridge has been in printing service ($k_3$) varies while being weighted with a relative ratio of 1.14 (rounded off to two decimal places), 1.20 and 1.27. Therefore, it will be more effective in estimating the actual quantity of residual toner if the weighting correction coefficient in double-sided printing mode ($k_3$) is applied to equation (3) and equation (4) when performing double-sided printing.

A correction coefficient depending on resolution (dpi) ($k_4$) may be set as indicated in Table 7.

TABLE 7

| | Resolution (dpi) | |
|---|---|---|
| | 600 dpi | 1200 dpi |
| Correction coefficient ($k_4$) | 1 | 1.5 |

In order to make the controller 180 select one of a plurality of values for the resolution correction coefficient ($k_4$) stored in the coefficient memory 182, a user may input resolution information using the manipulation panel 160. In addition, it is possible for the user to input resolution information using a computer not shown in the drawings beyond the manipulation panel 160.

A correction coefficient depending on density ($k_5$) may be set as shown in Table 8 depending on the state of an image to be printed on paper, that is, light, medium or dark state.

TABLE 8

| | Output density | | |
|---|---|---|---|
| | Medium | Light | Dark |
| Correction coefficient (K5) | 1 | 0.8 | 1.2 |

In order to make the controller 180 select one of a plurality of values for the density correction coefficient ($k_5$) stored in the coefficient memory 182, the user may input density information using the manipulation panel 160. In addition, it is also possible for the user to input density information using a computer.

A correction coefficient concerning toner saving mode ($k_6$) can be set as shown in Table 9 depending on whether the toner saving mode is selected or not.

TABLE 9

| | Selection of toner saving | |
|---|---|---|
| | OFF | ON |
| Correction coefficient (k6) | 1 | 0.7 |

In order to make the controller 180 select one of a plurality of values for the toner saving mode correction coefficient ($k_6$) stored in the coefficient memory 182, the user may input toner saving mode information using the manipulation panel 160. In addition, it is also possible for the user to input toner saving mode information using a computer.

A correction coefficient for intensifying respective dots of an image to be printed ($k_7$) can be set as indicated in Table 10.

TABLE 10

| | Intensifying image quality | | |
|---|---|---|---|
| | Normal | Text | Image |
| Correction coefficient (K7) | 1 | 0.7 | 1.1 |

In order to make the controller 180 select one of a plurality of values for the dot intensifying coefficient ($k_7$) stored in the coefficient memory 182, the user may input dot intensifying information using the manipulation panel 160. In addition, it is also possible for the user to input toner intensifying information using a computer.

A correction coefficient concerning a surrounding environmental condition (e) is set as indicated in Table 11 depending on environmental conditions calculated depending on temperature and humidity, that is, low temperature and low humidity, normal temperature and normal humidity, and high temperature and high humidity conditions.

TABLE 11

| | Surrounding environmental condition | | |
|---|---|---|---|
| | Low temperature & low humidity | Normal temperature & normal humidity | High temperature & High temperature |
| Q'ty of transferred toner (e1) | 0.9 | 1 | 1.2 |
| Q'ty of waste toner (e2 | 1.2 | 1 | 1.5 |

Low temperature and low humidity are referenced to about 10° C. and 10%, respectively, normal temperature and normal humidity are referenced to about 23° C. and 55%, respectively, and high temperature and high humidity are referenced to about 30° C. and 80%, respectively. In order to obtain information for calculating an environmental condition that allows the controller 180 to select one value for each environmental correction coefficient (e) among a plurality of values for the environmental correction coefficients stored in the coefficient memory 182, the image forming apparatus may include a temperature sensor and a humidity sensor so that the surrounding temperature and humidity can be detected.

Although the coefficients for each mode are exemplified as being set in two or three divided stages, they can be more finely divided as needed.

Therefore, at the time of printing substantially the 5,000$^{th}$ page ($k_1$=1.32, $k_2$=1.07), if printing mode is double-sided printing (in the quantity of transferred toner, $k_3$=1.20, and in the quantity of waste toner, $k_3$=1.19), the resolution is 1,200 dpi ($k_4$=1.5), the density is normal ($k_5$=1), the toner saving mode is selected ($k_6$=0.7), the intensification of image quality is normal ($k_7$=1), and the environmental condition is normal humidity and normal humidity ($e_1$=$e_2$=1), the quantity of transferred toner can be calculated as follows, on the basis of equation (3):

$$Q_t=\Sigma(x\cdot 1.32\cdot 1.20\cdot 1.5\cdot 1\cdot 0.7\cdot 1\cdot 1\cdot N_{dot}\cdot q_{dot})=\Sigma(x\cdot 1.66\cdot N_{dot}\cdot q_{dot})$$

where, $Q_t$ is the quantity of transferred toner, $N_{dot}$ is the number of dots, and $q_{dot}$ is the quantity of transferred toner per dot; and according to equation (4), the quantity of produced waste toner is calculated as follows:

$$Q_w=1.07\cdot 1.19\cdot t_r\cdot Q'_{BG}=1.27t_r\cdot Q'_{BG}$$

where $Q_w$ is the quantity of produced waste toner, $t_r$ is the length of time for rotating a photosensitive medium, and $Q'_{BG}$ is the BG quantity per unit time.

Accordingly, the weighting value for the quantity of transferred toner is 1.66 and the weighting value for the quantity of produced waste toner is 1.27; these are applied to calculate the quantity of residual toner.

A method for measuring the quantity of residual toner in accordance with an embodiment will now be described with reference to FIGS. 1 to 5.

The user inputs information related to correction coefficients for respective modes through the manipulation panel 160 prior to performing a printing operation. The controller 180 can select, for each mode, one value for each correction coefficient stored in the memory 182 and meets the conditions of the respective modes. The user can also input the information through an external source, such as a computer (not shown), that is beyond the manipulation panel 160 (S10).

Controller 180 detects the surrounding environment using a temperature sensor and humidity sensor installed in the image forming apparatus. Thus, one value for the environmental correction coefficient (e) can be selected among the plurality of values for the correction coefficient that are stored in the memory 182 and meet the respective environmental conditions (S11).

If the controller 180 applies a print or copy command to the print engine according to a command inputted through the manipulation panel 160 or an external source, such as a computer (not shown), by the user, the printing operation is initiated (S12).

The counter unit 184 of the controller 180 counts and stores the number of dots for one page of print data (S13). In addition, the counter unit 184 also counts the number of pages (S14).

The operation unit 186 of controller 180 selects one value for each correction coefficient among the plurality of values for the correction coefficients (k, e) stored in the coefficient memory 182 according to a condition such as the length of time a toner cartridge has been in printing service, the density of toner, or an image, and calculates and stores the quantity of transferred toner per page using the values of the selected correction coefficients and the counted number of dots (S15).

The operation unit 186 of the controller 180 determines whether a corresponding page is the last one to be printed (S16). If it is not the last page, the above-mentioned steps are repeated, and if it is the last page then the operation unit accumulates the sum of the quantity of transferred toner per page to calculate the quantity of transferred toner via equation (3), and the quantity of produced waste toner via equation (4). Thus, the number of printed pages of paper per job ($P_j$) are calculated as in equation (2) using the calculated quantities (S17).

The operation unit 186 of the controller 180 reads the number of residual printable pages ($P_{r-m}$), calculates the number of printable pages on the basis of the calculated number of printed pages per job ($P_j$) and the number of residual printable pages ($P_{r-m}$) read out from the residual toner data memory 190 and updates the residual toner data memory to store the calculated number of printable pages of papers ($P_r$) (S18).

Controller 180 renders the display unit 170 to directly display the number of printable pages, which corresponds to the quantity of residual toner or emits a "toner low" or "toner empty" signal when the number of printable pages of paper ($P_r$) is not more than a predetermined reference value, so that the user is informed that the toner cartridge is required to be replaced because image quality is deteriorated (S19). Although not shown, it is also possible to inform the user of such a situation through a computer drive or to inform the user how long the toner cartridge has served by printing one page.

Although it has been exemplified that the quantity of transferred toner per page is calculated and accumulatively summed to calculate the number of printed pages per job ($P_j$) in the above-mentioned examples, the present invention is not limited to this. It is possible to store and accumulate the counted number of dots per page, and it is also possible to apply respective correction coefficients to the accumulated number of dots to calculate the number of printed pages per job ($P_j$).

As described above, according to an aspect of the present invention, it is possible to estimate the quantity of residual toner close to an actual value by applying correction coefficients weighted depending on the length of time the toner cartridge has been in printing service. In addition, by applying a correction coefficient weighted depending on whether the printing is performed in single-sided mode or double-sided mode, the quantity of residual toner can be estimated close to an actual value. Therefore, it is possible to maintain image quality and to inform the user of an accurate time for changing a toner cartridge.

In addition, because the quantity of residual toner is calculated by applying values changed depending on various parameters such as resolution, image density, temperature and humidity, it is possible to prevent the occurrence of error in measuring the quantity of residual toner.

While certain exemplary embodiments of the present invention have been shown and described in order to exemplify the principle of the present invention, the present invention is not limited to the specific embodiments. It will be understood that various modifications and changes can be made by those of ordinary skill in the art without departing from the spirit and scope of the invention as defined by the appended claims. Therefore, it shall be considered that such modifications, changes and equivalents thereof are all included within the scope of the present invention.

What is claimed is:

1. A device for measuring the quantity of residual toner received in a toner cartridge comprising:

a controller for selecting one among a plurality of preset values for a correction coefficient, which is weighted increasingly depending on the length of time the toner cartridge has been in printing service, and calculating a quantity of residual toner using the selected values for a plurality of correction coefficients and a counted number of dots of a print data; and a residual toner data memory, wherein the quantity of residual toner calculated by the controller is updated and stored in the residual toner data memory, wherein the plurality of preset values for the correction coefficients further include a plurality of values for a paper-feeding mode correction coefficient ($k_3$) which is related to a quantity of transferred toner and/or waste toner and which is applied differently depending on whether single-sided printing or double-sided printing is performed.

2. A device as claimed in claim 1, wherein the plurality of preset values for the correction coefficients include a plurality of values for a transferred toner quantity correction coefficient ($k_1$) and a plurality of values for a waste toner quantity correction coefficient ($k_2$), which are respectively weighted increasingly depending on the length of time the toner cartridge has been in printing service.

3. A device as claimed in claim 1, wherein the paper-feeding mode correction coefficient ($k_3$) of double-sided printing is greater than the paper-feeding mode correction coefficient ($k_3$) of single-sided printing.

4. A device as claimed in claim 3, wherein the controller composes:

a coefficient memory for storing the plurality of preset values for the correction coefficients;

a counter unit for counting the number of dots and the number of pages for print data; and an operation unit for selecting one value for each correction coefficient among the plurality of preset values for the correction coefficients stored in the coefficient memory and calculating the quantity of residual toner using the selected values for the correction coefficients and the number of dots of print data counted by the counter unit, the operation unit updating and storing the calculated quantity of residual toner in the data memory.

5. A device as claimed in claim 4, wherein the coefficient memory further stores a plurality of values for a resolution coefficient ($k_4$), which changes depending on print data resolution, and the operation unit selects one value among the plurality of values for the resolution correction coefficient to calculate the quantity of residual toner additionally using the selected value for the resolution correction coefficient.

6. A device as claimed in claim 4, wherein the coefficient memory further stores a plurality of values for a density correction coefficient ($k_5$), which changes depending on print data density, and the operation unit selects one among the plurality of values of the density correction coefficient to calculate the quantity of residual toner additionally using the selected value for the density correction coefficient.

7. A device as claimed in claim 4, wherein the coefficient memory further stores a plurality of values for a toner saving mode correction coefficient ($k_6$), which changes depending on toner saving mode, and the operation unit selects one among the plurality of values for the toner saving mode correction coefficient to calculate the quantity of residual toner additionally using the selected value for the toner saving mode correction coefficient.

8. A device as claimed in claim 4, wherein the coefficient memory further stores a plurality of values for an environmental correction coefficient (e), which changes depending on environmental condition preset according to at least one of temperature and humidity, and the operation unit selects one of the plurality of values for the environmental correction coefficient depending on at least one of the temperature and the humidity to calculate the quantity of residual toner additionally using the selected environmental correction coefficient.

9. A device as claimed in claim 1, further comprising an information unit for externally informing the quantity of residual toner calculated by the controller.

10. An image forming apparatus comprising:

a toner cartridge for containing toner;

a residual toner data memory for storing data information related to intrinsic information of the toner cartridge and data information related to a quantity of residual toner, the residual toner data memory being mounted on a side of the toner cartridge;

a controller for calculating the quantity of residual toner using a plurality of preset values for a transferred toner quantity correction coefficient ($K_1$), a waste toner quantity correction coefficient ($K_2$), and a paper-feeding mode correction coefficient ($K_3$), each of which changes increasingly depending on the length of time the toner cartridge has been in printing service, and the counted number of dots of print data, wherein the controller updates and stores the calculated quantity of residual toner in the residual toner data memory; and a display unit for externally displaying the quantity of residual toner calculated by the controller, wherein the paper-feeding mode correction coefficient is related to a quantity of transferred toner and/or waste toner and is applied differently depending on whether single-sided printing or double-sided printing is performed, wherein the paper-feeding mode correction coefficient of double-sided printing is greater than the paper-feeding mode correction coefficient of single-sided printing.

11. An image forming apparatus as claimed in claim 10, wherein the controller calculates the quantity of residual toner additionally using one or more values each selected among a plurality of values preset for a resolution coefficient ($K_4$) changed depending on print data resolution, a density correction coefficient ($K_5$) changed depending on print data density, a toner saving mode correction coefficient ($K_6$) changed depending on toner saving mode, and an environmental correction coefficient (e) changed depending on environmental condition preset according to at least one of temperature and humidity.

12. An image forming apparatus as claimed in claim 11, further comprising a manipulation panel for allowing a user to input information so that the controller can select one value for each of the plurality of correction coefficients.

13. A method of measuring the quantity of residual toner, the method comprising:

counting the number of dots of print data;

selecting one value for each of a plurality of preset correction coefficients, each coefficient being weighted increasingly depending on the length of time a toner cartridge has been in printing service;

calculating the quantity of residual toner using the selected values for the correction coefficients and the counted number of dots; and storing the calculated quantity of residual toner, wherein selecting one value for each correction coefficient comprises selecting one of a plurality of values for a paper-feeding mode correction coefficient ($K_3$) which is related to a quantity of transferred toner and/or waste toner and which is applied differently depending on whether printing in single-sided mode or double-sided mode is performed.

14. A method as claimed in claim 13, wherein selecting one value for each correction coefficient further comprises:

selecting one of a plurality of values for a transferred toner quantity correction coefficient ($K_1$); and selecting one of a plurality of values for a waste toner quantity correction coefficient ($K_2$), wherein the paper-feeding mode correction coefficient ($K_3$) of double-sided printing is greater than the paper-feeding mode correction coefficient ($K_3$) of single-sided printing.

15. A method as claimed in claim 14, wherein selecting one value for each correction coefficient further comprises:

selecting one of a plurality of values for a resolution correction coefficient ($K_4$) changed depending on preset print data resolution.

16. A method as claimed in claim 14, wherein selecting one value for each correction coefficient further composes:

selecting one of a plurality of values for a density correction coefficient ($K_5$) changed depending on preset print data density.

17. A method as claimed in claim 14, wherein selecting one value for each correction coefficient further comprises:

selecting one of a plurality of values of a saving mode correction coefficient ($K_6$) changed depending on preset toner saving mode.

18. A method as claimed in claim 14, wherein selecting one value for each correction coefficient further comprises:

selecting one of a plurality of values of an environmental correction coefficient (e) changed depending on at least one of temperature and humidity.

19. A method as claimed in claim 13, further comprising externally informing the calculated quantity of residual toner.

20. A device for measuring the quantity of residual toner received in a toner cartridge comprising:

a controller for calculating a quantity of residual toner by using a correction coefficient which is related to a quantity of transferred toner and/or waste toner and which is weighted according to whether printing is performed using a single-sided or double-sided printing mode and by a counted number of dots of a print data; and a residual toner data memory, wherein the quantity of residual toner calculated by the controller is updated and stored in the residual toner data memory, wherein the correction coefficient of double-sided printing mode is greater than the correction coefficient of single-sided printing.

* * * * *